United States Patent [19]

Neuhierl

[11] Patent Number: 4,540,119

[45] Date of Patent: Sep. 10, 1985

[54] FLEXIBLE TRACK SEGMENT

[75] Inventor: Hermann Neuhierl, Fürth, Fed. Rep. of Germany

[73] Assignee: Neuhierl GmbH & Co. KG, Fürth, Fed. Rep. of Germany

[21] Appl. No.: 407,438

[22] Filed: Aug. 12, 1982

[30] Foreign Application Priority Data

Aug. 18, 1981 [DE] Fed. Rep. of Germany ..... 3132527

[51] Int. Cl.[3] ..... A63H 18/02; E01B 23/00

[52] U.S. Cl. ..... 238/10 R; 238/10 F

[58] Field of Search ..... 238/10 A, 10 B, 10 C, 238/10 E, 10 F, 10 R; 403/140, 141, 142

[56] References Cited

U.S. PATENT DOCUMENTS

| | | | |
|---|---|---|---|
| 1,076,044 | 10/1913 | Kintner | 238/10 C |
| 1,694,528 | 12/1928 | Clarkson | 238/10 R |
| 2,675,179 | 4/1954 | Johnson | 238/10 C X |
| 4,142,816 | 3/1979 | Kramer | 403/141 X |
| 4,241,875 | 12/1980 | Vandenbrink | 238/10 F |
| 4,254,907 | 3/1981 | Pine | 238/10 R X |
| 4,372,489 | 2/1983 | Lee | 238/10 E X |

*Primary Examiner*—Robert B. Reeves
*Assistant Examiner*—Dennis C. Rodgers
*Attorney, Agent, or Firm*—Wood, Dalton, Phillips, Mason & Rowe

[57] ABSTRACT

A flexible track segment for freely moving, driven, track-bound toy cars with a guide edge for guiding toy cars is specified, which consists of separate track segments, which can be put together, and which are capable of swivelling against each other, and, if necessary, connecting pieces. Each track segment part and connecting piece displays a travelling surface between the guide edges. The track segment parts and the connecting pieces are connectable with each other over the contact of linkage elements and receiving parts. The linkage element displays a pair of jaws with hook-forming, pointing to each other ends, which project away from a front side of the track segment part. The receiving part is constructed on the other front side of the track segment part and displays an opening and a vertical pin, which outside is aligned with the front side. The distance of the hook-forming ends is smaller and the distance of the jaws is larger than the diameter of the pin. In the put-together condition, the pin is held in the oval space which is between the jaws, the front side and the hook-forming ends. The adjacent track segment parts, over this contact, are capable of swivelling against each other in the horizontal and the vertical plane surface. The track segment, which consists of track segment parts, is formable in all directions like an accordion. The connecting pieces are connectable on one side with the track segment parts and are constructed on the other side for the connection, for example, to the rigid track segments or connecting parts of other track segments. The upper sides of the guide edges can be provided for building a uniform pattern of the projecting tongues of the upper side and these tongues display receiving cavities. Tools can be provided for the assembly and dismantling.

16 Claims, 30 Drawing Figures

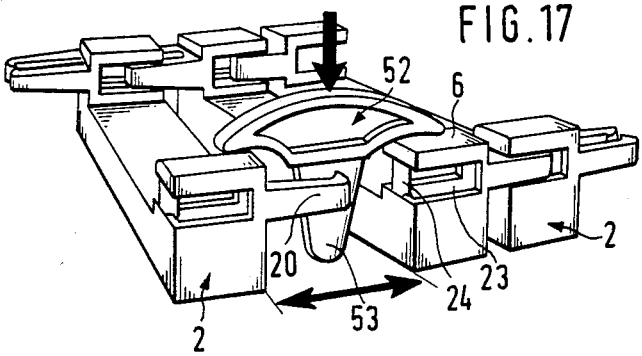
FIG. 17
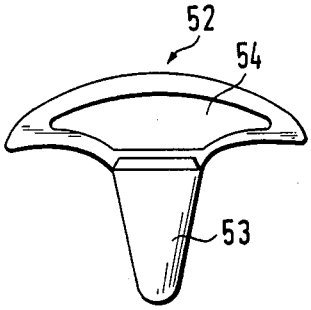
FIG. 16
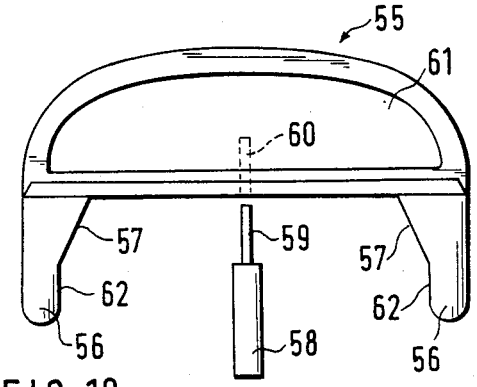
FIG. 18
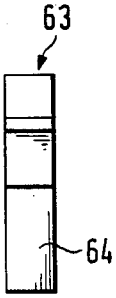
FIG. 19
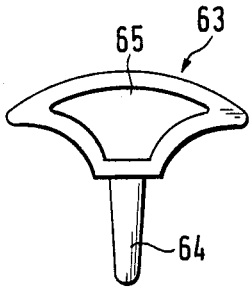
FIG. 20
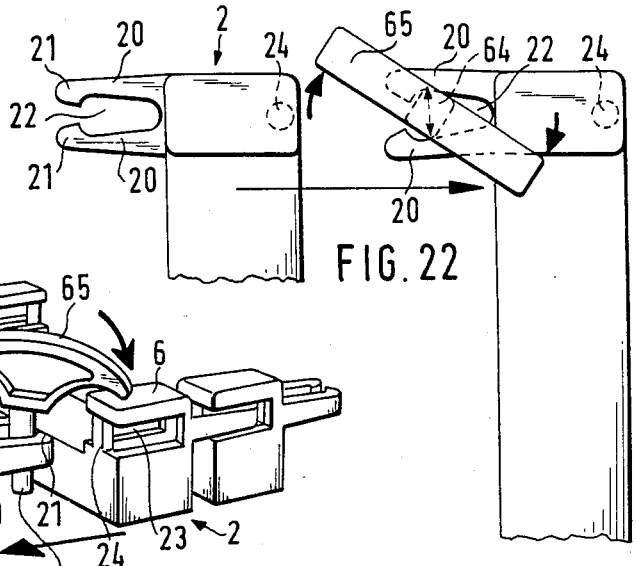
FIG. 22
FIG. 21
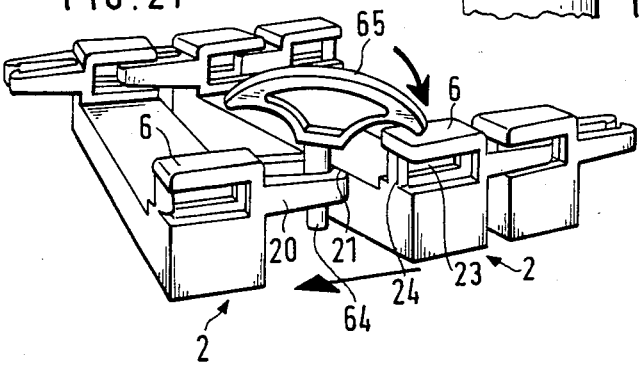

FLEXIBLE TRACK SEGMENT

The invention concerns a flexible track segment for freely moving, driven, track-bound play vehicles with a guide edge for directing the play vehicles, consisting of separate track segment parts which can be put together and which are capable of swivelling against each other.

Such flexible track segments are known from the DE-OS No. 29 46 890 and the DE-OS No. 29 28 013 (=U.S. Pat. No. 4,241,875). By the known track segments each track segment part displays a travelling surface, at least one linkage element, which is supplied with a projecting part and a locking part, which projects on a front side, at least one receiving unit on the other front side for receiving in a locking manner a linkage element on the adjacent track segment part and guiding links in the area of the guide edge, which catch in the corresponding contact links of the adjacent track segment with play in all directions.

By the flexible track segment, in accordance with the DE-OS No. 29 46 890, the edge-sided guiding links are formed by means of pins, which reach into the openings of an adjacent track segment part. By the DE-OS No. 29 28 013 the tongues reach into cavities, however, they are not anchored there. Finally, the U.S. Pat. No. 2,675,179 still shows a flexible track segment part for toy railroads, by which edge-sided, rail-forming pin/-housing links reach into each other in a shifting manner. Accordingly, by the known flexible track segments the linkage element and its receiving part are supplied coaxially. By the toy railroad, which is in accordance with the U.S. Pat. No. 2,675,179, a connecting rail is provided which is here running coaxially over the entire road piece and which is squeezed into a groove. By both other track segments a pin-like linkage element projects coaxially, which can be locked in a correspondingly formed receiving part in the other front side of the adjacent road piece part.

Consequently, by the known flexible track segments it is essential that a neutral central axis is present, the longitudinal extension of which is unchangeable. The known flexible track-segments are, therefore, usable as track segments of a changeable radius. Of course, a certain deformability is also possible in a vertical direction.

Relative to dimensioning of tracks for freely moving, driven, track-bound play vehicles (cars), definite requirements are under consideration. These follow from the route survey which is to be built by the player, that is by a child. In general, by such tracks straight and bent fixed track segments are built together. However, with the use of fixed track segments only a small number of different route surveys can be obtained, whereby the play attraction for the playing child is strongly limited. For somewhat complicated route surveys, therefore, usually by the manufacturers section-track segments, such as $\frac{1}{2}$, $\frac{1}{3}$, $\frac{1}{4}$ . . . -track segments, are placed at the disposal, so that also route surveys of complicated assemblies can be produced. Certainly the use of flexible track segments with the known assembly, that is with a changeable radius, simplifies the assembly of complicated route surveys.

However, it can also happen that during the assembly a designed route survey does not go up using the known rigid and flexible track segments, that is, the beginning and the end of a route survey do not fit together. Now a section-track segment must be sought, which makes the connection possible and then mostly a reconstruction should be made over a certain part of the chosen route survey. In that way, the playing child very quickly loses the desire to play.

The case, in which the route survey does not go up between the beginning and the end, is then frequently given when several children are building a route survey together. Frequently then, for the achievement of the necessary connection between the beginning and the end, a fight starts how the already established route survey should be reconstructed.

Therefore, the task of the invention (in order to avoid this disadvantage) is to specify a flexible track segment which can slide and bend in all directions.

Thus, a flexible track segment should be created which also can be shifted in the longitudinal extension of the roadway of the track segment.

In accordance with the invention, this is achieved in such a manner that the guiding links are formed as a linkage element and the contact links are formed as a corresponding receiving part and are supplied only in the area of the guide edge, that is, a central connection between the adjacent track segment parts, which prevents a movement in the direction of the roadway, is not available anymore, however, a similar sure linkage between the adjacent track segment parts is achieved. Consequently, the invention indicates a flexible track segment which is not only diagonal in the direction of the travel and perpendicular in the travel direction, but also formable in the travel direction. This also permits the assembly of bridge ascents, hill climbs, descents or bridge descents as well as the assembly of curves and S-track segments. Advantageously, for this purpose, supports with optional or changeable heights can be pressed against the lower side of the track segment part.

By means of the flexible track segment, which is constructed in accordance with the invention, at least in the elevated circumference the preparation of section-track segments and, of course, for straight as well as curved track segments, can be abandoned. With the help of the flexible track segment, which is formed in accordance with the invention, even a small child can construct any travelling roads in a free configuration without the need of overcoming considerable difficulties for connecting the beginning and the end, such as the search for section-track pieces or the reconstruction of a larger route segment. Consequently, even a small playing child can give freedom to his phantasies by the configuration of the travelling roads.

A further play attraction is because of an advantageous construction where the individual track segments can be separated from each other and can again be put together. This intervenes especially then when this assembling or dismantling can be accomplished at least by smaller children only with the help of a tool. The play attraction follows already from the knowledge that with the help of tools results can be achieved which without tools cannot yet be obtained, or which without tools can be obtained only by adults or big children. On the other hand, it is made impossible that the individual track segments could become loose by themselves in spite of not always careful handling by especially small children.

Further, it is advantageous when especially for play vehicles, which run by themselves on the guide edge (as, for example, toy railroads), tongues project on the upper side, which reach into the corresponding cavities of the adjacent track segments in order to obtain in this manner a continuous path of the upper side of the guide edge.

A further play attraction is that the individual track segments can be connected with each other in any length; if necessay, entire travelling extensions can be constructed using only such track segments. On the other hand, it is possible to obtain a connection by connecting pieces to usually rigid (stiff) track segments.

The track segment, which is built in accordance with the invention, is especially suitable for self-driven toy vehicles (cars), as those which display a clockwork or battery-operated electric motor. However, the invention is also suitable for track segments for play vehicles by which power supplies are furnished in the area of the track segment. In this case, the power supplies must be flexible and also variable in a travel track extension; for this purpose then they consist of spirals (coils) or similar.

The invention is explained using the construction examples, as illustrated in the drawing.

It is shown:

BRIEF DESCRIPTION OF THE DRAWINGS

FIG. 16 is an elevation view of an alternative form of dismantling tool for the track segment parts;

FIG. 17 is a perspective view of the dismantling tool of FIG. 16 separating adjacent track segment parts;

FIG. 18 is an elevation view of an alternative form of assembling tool for track segment parts;

FIG. 19 is a side elevation view of a further dismantling tool;

FIG. 20 is a front elevation view of the dismantling tool of FIG. 19;

FIGS. 21 and 22 demonstrate the dismantling tool of FIG. 19 separating adjacent track segment parts;

FIG. 1 shows a flexible track segment 1 for freely moving, driven, trackbound play vehicles (not illustrated). The track segment 1 essentially displays a nearly central travelling road with guide edges.

Figure 1:
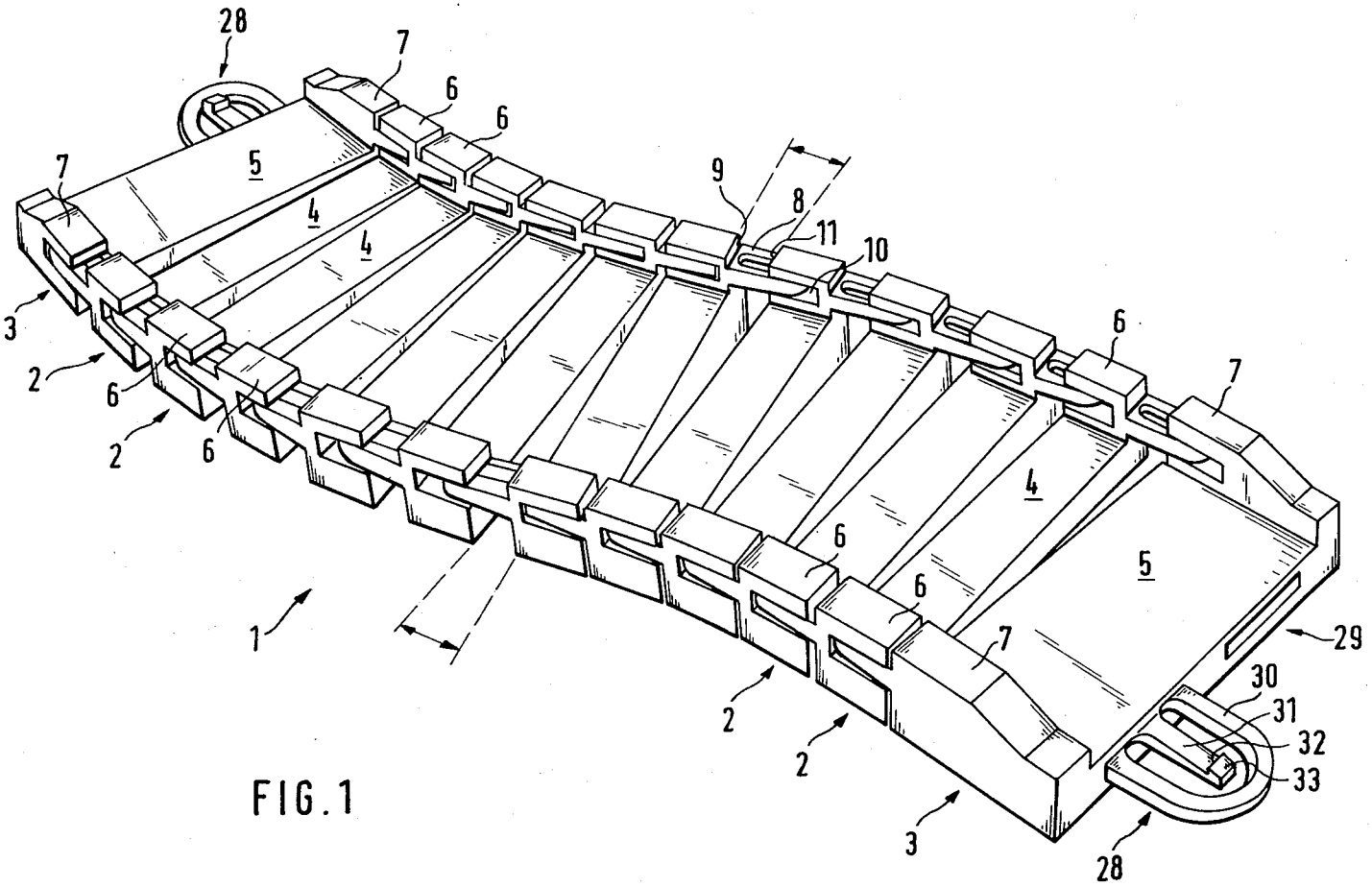
FIG. 1 is a perspective view of a flexible track segment according to the present invention and demonstrating bending in a horizontal direction.

The track segment 1 consists of several track segment parts 2, which can be assembled and which are capable of swivelling against each other. On both sides of the track segment section, which is constructed in such a manner, the connecting pieces 3 are connected in a similar manner with the thereby adjacent track segment parts 2, that is, assembled and capable of swivelling against each other.

The track segment part 2 displays an almost central travelling surface 4, whereby the travelling surfaces 4 of all adjacent track segment parts 2 and the corresponding travelling surfaces 5 of the connecting pieces 3 form the track of the track segment 1. Further, each track segment part 2 displays a guide edge 6 to the right and to the left. In the same way, each connecting piece 3 displays a corresponding guide edge 7 on the travelling surface side.

The adjacent track segment parts 2, just as the connecting piece 3, are connected together with the adjacent track segment part 2 in the area of the guide edge and, of course, on one side by means of a linkage element 8, which projects away from a front side, and on the other side by means of a receiving piece 10, which is formed in the front side 11 (which is opposite to the linkage element 8) of the adjacent track segment part 2 (or to the connecting piece 3). The receiving piece 10 is formed for the locking take-up of the linkage element 8, as it is further explained more thoroughly.

The linkage element 8 and the receiving part 10, reciprocally adjusted, are formed in such a manner that the adjacent track segment parts 2 or the track segment part 2 and the connecting piece 3 in the track extension between two end positions can be shifted arbitrarily. The end positions are, on one hand, determined by the reciprocal (mutual) installation of the front sides 9 and 11 and, on the other hand, by a point, at which the linkage element 8 and the receiving part 10 are exactly still in contact. The front sides 9 and 11, however, are removed far from each other.

As it follows from FIG. 1, thereby both contact parts 8 and 10, which are assigned to each guide edge 6 or 7, can be in different end positions, independent from each other, so that in the horizontal plane surface a swung track path can be obtained. Further, it shows that the track segment 1 over this locking connection between the track segment parts 2 and the connecting pieces 3 can be shifted together and pulled apart in the manner of an accordion. The track segment 1, therefore, is arbitrarily movable between two sizes of the track length. Thereby, a wave-forming path and a change in the length of the track can be schemed with one another. In this manner, the track segment 1, which is in accordance with the invention, can then especially be used, when a track, which is constructed with rigid track segments, does not go up with the use of the rigid track segments, that is, the use of rigid section-track segments would be necessary, such as $\frac{1}{2}$, $\frac{1}{3}$, $\frac{1}{4}$, . . . track segments. Consequently, a maintenance of supplies of such different section-track segments is no longer necessary. Moreover, of course, the entire track can also be constructed with the track segments, which are in accordance with the invention. Especially by the assembly with rigid curved track segments the flexible track segment, which is in accordance with the invention, is of a considerable advantage, inasmuch as the playing child in this way can build any track extension in a free configuration, without having to search for a long time for the necessary section-track segment at the end and to try out, or to try with force to connect the rigid track segments with each other, whereby these, under circumstances, could be damaged. Thereby, the joy of play of the child is encouraged.

Figure 2:
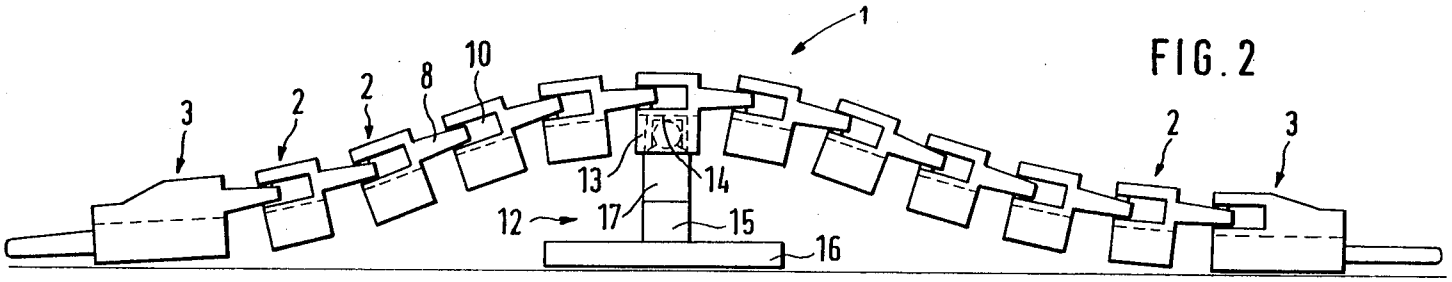
FIG. 2 is a side elevation view of a flexible track segment according to the present invention demonstrating vertical bending away from a central, vertical support.
Figure 3:
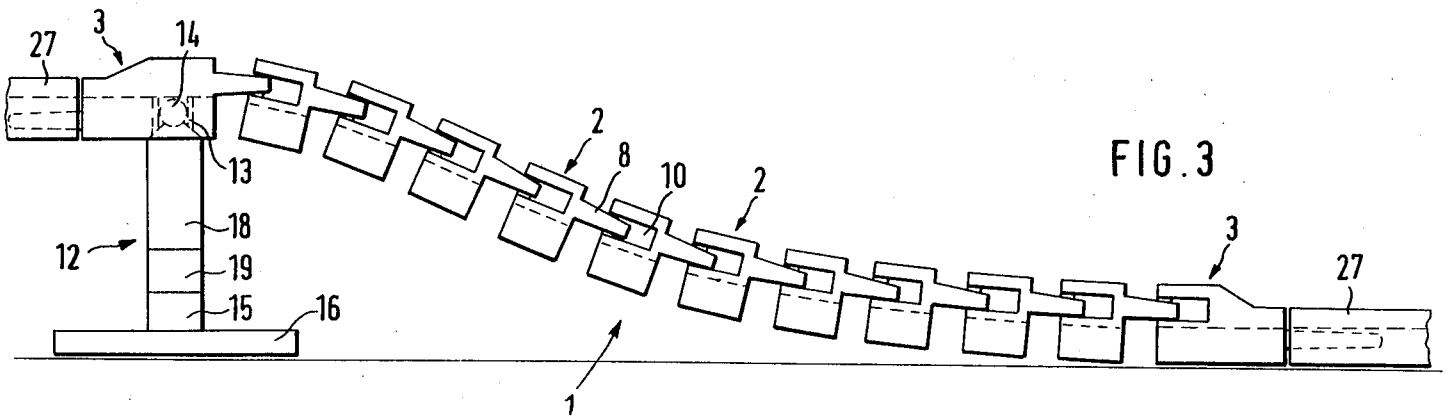
FIG. 3 is a side elevation view of the flexible track segment in inclined situation extending between a flat surface and a support extending upwardly from the surface.
Figure 4:
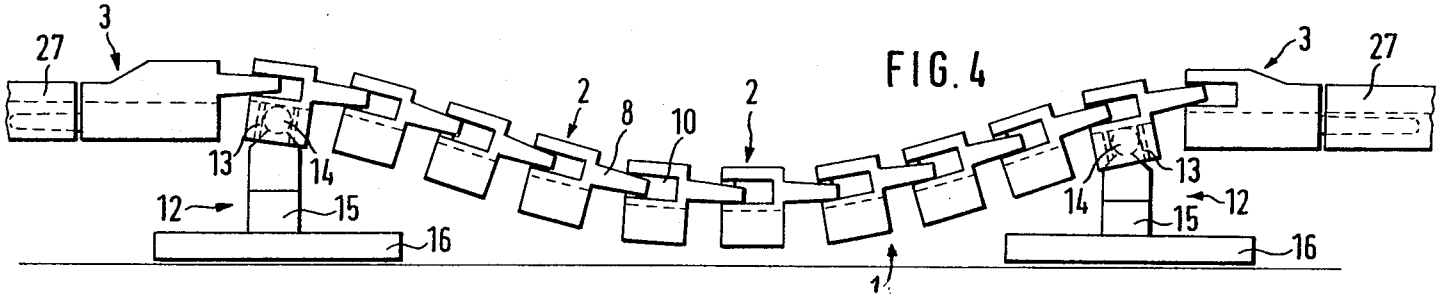
FIG. 4 is a side elevation view of a flexible track segment demonstrating vertical bending between two raised supports.

However, the flexible track segment, which is in accordance with the invention, can be shifted not only in the horizontal plane surface but also in the vertical plane surface, as it is illustrated more thoroughly in FIGS. 2 to 4. Already on account of the small play (backlash), which must exist between the linkage element 8 and the receiving part 10, in order to be able to shift these against each other, a bending of the track segment is obtained in the vertical plane surface. This bending possibility is also promoted in such a way that knowingly a play between a linkage element 8 and the receiving part 10 is provided. This, for example, is possible because one or two surfaces of the linkage element 8 and/or the receiving part 10 do not run horizontally but are inclined toward the horizontal line, as it can be seen in FIGS. 2 to 4. Thereby, the travelling extensions can be constructed with climbs and descents. For example, FIG. 2 shows a hill to be crossed, FIG. 3 shows the passage between two different height positions and FIG. 4 shows a depression to be passed.

In addition, for this purpose, a support 12 can be built in the track segment.

By this, in FIGS. 2 to 4 of the illustrated model types at least some, preferably all track segment parts 2 and preferably also the connecting pieces 3 on the bottom side display the cup-forming cavities 13. Preferably such cup-forming cavities are always provided either near or in the guide edge 6 or 7. The assigned support 14 displays a ball 14 on the upper end or another ball-forming link which snaps into the cup-forming cavity 13. In this manner, the holding and supporting of the flexible track segment is possible independent from the inclination of the actual (respective) travelling surfaces 4 or 5 opposite the base support. In this manner also curves with superelevation can be constructed.

Supports of different heights can be used. For example, as indicated in FIGS. 2 to 4, the support consists of a base piece 15 with a wide areal (laminar) stationary base 16 on which column (support) pieces 17, 18 of different height measurements can be put on. The column pieces have a ball 14 on their upper end. Of course, column intermediate pieces 19 can also be used in order to keep as small as possible the number of the ready made pieces. This is indicated in FIG. 3. The base part 15 and the column pieces 17, 18 or 19 can also be connected with each other through a locking connection, for example, in such a manner that the column pieces are made tubular, whereby on one end tongues project away axially with an outer diameter which is smaller than the outer diameter of the rest of the column piece, whereby the inner diameter of the column piece is not larger than this outer diameter. In this manner, through interlocking, the column pieces can be piled up on each other.

It is to be stated further that the supports 12 can be used not only in the pulled apart condition of the track segment parts 2 of the track segment 1 but also in the pushed together or partially pushed together condition. Thereby, of course, the minimal hill or depression radius in the complete pushed together condition is larger than in the pulled apart condition.

Figure 7:
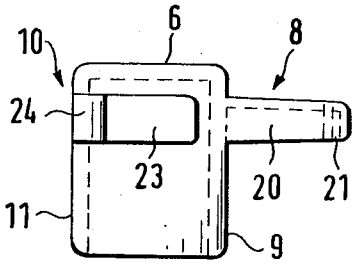
FIG. 7 is a side elevation view of the track segment part of FIG. 5.
Figure 5:
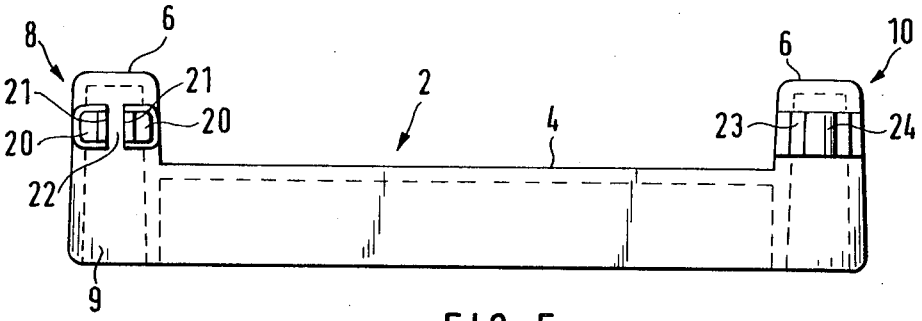
FIG. 5 is an end elevation view of one of the track segment parts.
Figure 6:
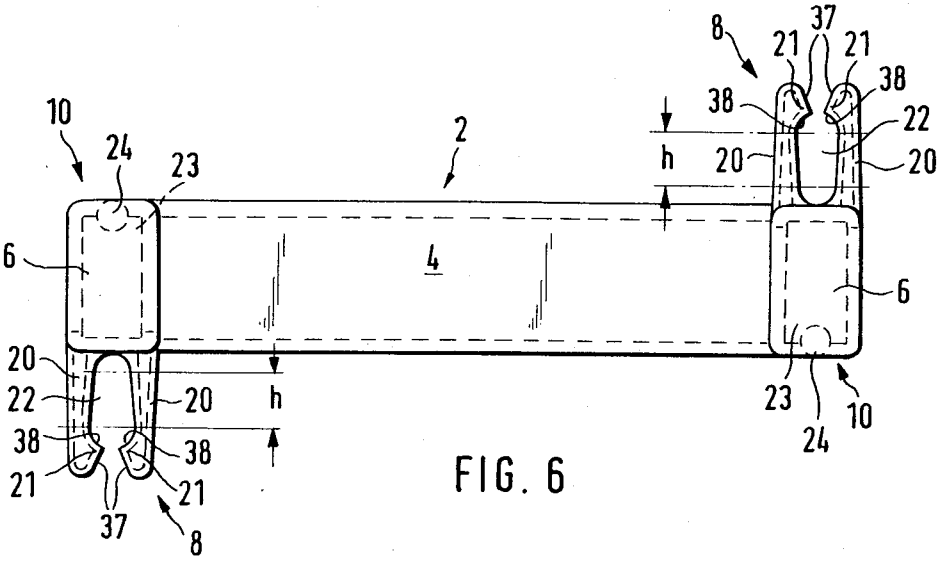
FIG. 6 is a plan view of the track segment part of FIG. 5.

A construction example of a track segment piece 2 is explained more thoroughly by means of FIGS. 5 to 7.

The track segment part 2 is produced from a (hygienic) synthetic material, for example, through injection molding, and can be colored in a different manner. The track segment part 2 displays the central almost horizontal travelling surface 4 and, in addition, on both sides the guide edges 6, on which the linkage element 8 as well as the receiving part 10 are built.

The linkage element 8 consists of a pair of jaws 20 with hook-forming ends, which are directed to each other. The jaws 20 project away from the one side 9 (FIG. 7) essentially in the horizontal direction, that is parallel to the travelling surface 4. As it is illustrated in FIG. 7, the upper sides and the bottom sides of the jaws 20 are tapered in such a manner that the horizontal section of jaws 20 which is the furthest removed from the side 9 has the smallest measurements in the vertical direction. Between both jaws 20 an essentially oval space 22 is formed.

On the other side 11 of the track segment 2 the receiving part 10 is constructed. The receiving part 10 consists of an essentially horizontal opening 23, which starts from the side 11 and which extends direct to the facing side 9. In this opening 23 a pin 24 is provided which is vertical to the travelling surface 4. The pin 24 is provided in the opening 23 as near as possible to the side 11 and it is arranged nearly central in regard to the guide edge 6. The diameter of the pin 24 is larger than the smallest distance of the hook-forming ends 21 (which are located opposite to each other) of a pair of jaws 20, however, smaller than the distance of the walls of the oval space 22 between the jaws 20 of one pair. It is shown that in the locked state the pair of jaws 20 and the pin 24 can be shifted against each other in the travelling surface extension in such a manner that in one end position the pin 24 is adjacent to the side 9 and in the other end position the pin 24 is installed on both hook-forming ends 21 of the pair of jaws 20. That is, the adjacent track segment parts 2 can be shifted against each other around a stroke h. The stroke h is further limited through the extension of the jaw 20 in the horizontal direction and the extension of the opening 23, also in a horizontal direction, as well as the position of the hook-forming ends 21 in regard to the outer located end of the jaw 20. The extension of jaws 20 in a horizontal direction should be in such a manner that the front ends of the jaws then on the end of the opening 23, turned to the jaws of the immediately following track segment part 2, do not yet directly collide when the facing sides 9 and 11 touch one another.

Of course, the pairs of jaws 20 by both guide edges 6 of the track segment 2 can project away in the same direction. This has the advantage then when the entire track is constructed from track segment parts, therefore, no connecting pieces 3 are provided.

Figure 10:
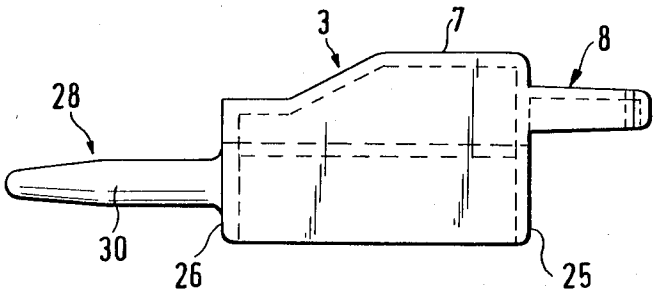
FIG. 10 is a side elevation view of the connecting piece of FIG. 8.
Figure 8:
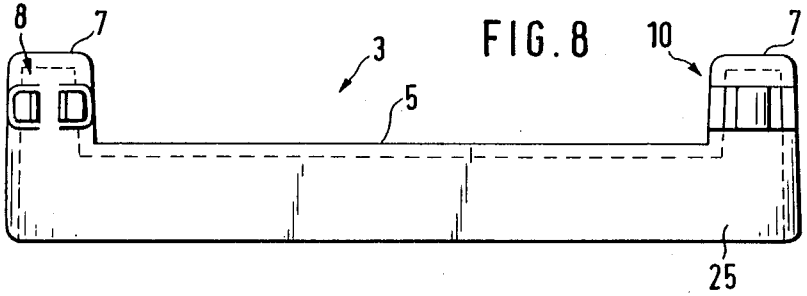
FIG. 8 is an end elevation view of a connecting piece for connecting track segment parts to other track segment parts.
Figure 9:
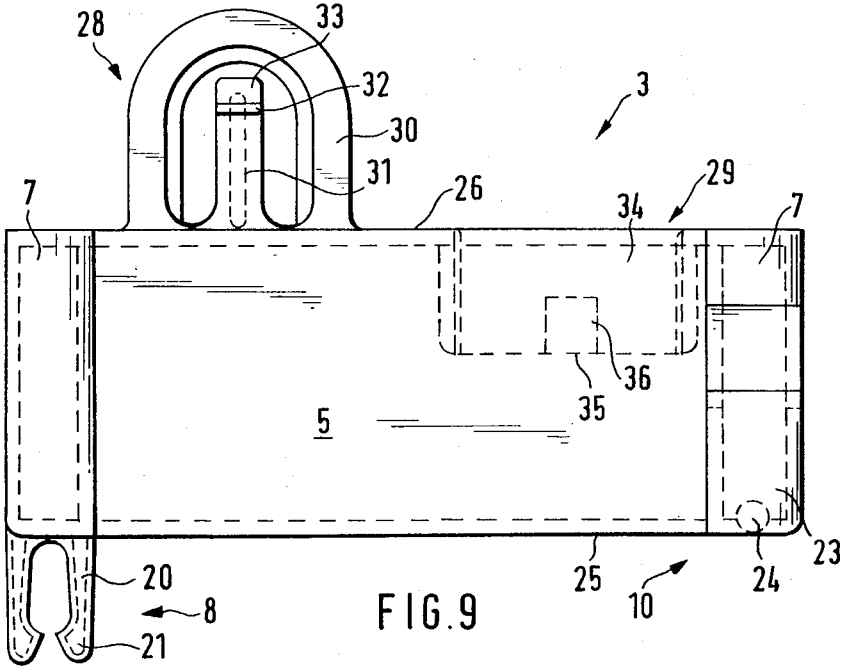
FIG. 9 is a plan view of the connecting piece of FIG. 8.

However, it is advantageous then when the connecting pieces 3 are provided, so that the pairs of jaws 20 from both guide edges 6 always project away in the opposite direction, as it is illustrated in FIG. 6. This has the advantage in that merely one kind of connecting pieces 3 is necessary, as it is explained more thoroughly by means of FIGS. 8 to 10.

As it already follows from the previous description, the connecting piece 3 is constructed on a side 25 in such a manner that it is connectable with adjacent track segment parts 2. On this side 25, either according to the first construction example or on both guide edges 7, a linkage element 8 or a receiving part 10 is provided, or, corresponding to the construction example, which is in accordance with FIGS. 5 to 7, on one of the guide edges 7 a linkage element 8 with a pair of jaws 20 with hook-forming ends 21, which point out to each other, and on the other guide edge 7 a receiving part 10 with the opening 23 and pins 24 is provided. Moreover, the construction and the measurement of this part of the connecting piece 3 correspond to those of the track segment parts 2 which are in accordance with FIGS. 5 to 7.

On the other side 26, on the other hand, the connecting piece is formed for the connection to the rigid track segments 27 or to other flexible track segments 1 over their connecting part 3 (see FIGS. 3 and 4).

Similar as by the track segment part 2, a linkage element 28 is provided on the side 26, on one side, and, on the other side, a receiving part 29 is provided. The linkage element 28 consists of one horizontal, strap-like pin 30, which springs away from the side 26, whereby in the same plane surface inside of the inner space, which is released by the strap-like pin 30, also almost horizontal from the side 26, a tongue 31 springs away, which on its front end has a hook 32 with a taper (inclination) 33 which runs from a front end in the direction of the side 26. The receiving part 29 consists of a pocket (trap) 34 which projects horizontally toward the inside from the side 26; this pocket, almost in the middle, has a hook 35 with a taper 36. The distance of the hook 35 of the receiving part 29 from the side 26 corresponds thereby to the distance of the hook 32 of the tongue 31 from the same side 26.

The linkage element 28 and the receiving part 29 are formed symmetrical to the center line of the travelling surface 5 in such a manner that the two connecting pieces 3 or one connecting piece 3 and a rigid track segment 27 are inserted (plug-in) with each other.

Figure 11:
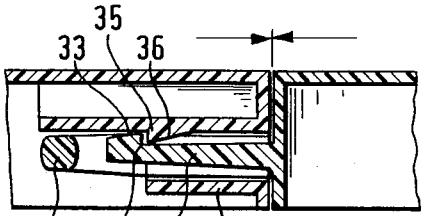
FIG. 11 is a fragmentary sectional view of the connection between of joined connecting pieces.

In this way, a strong but detachable connection results thereby, as it is shown in FIG. 11, in that both tapers 33 and 36 run one upon another and there behind then both hooks 32 and 35 interlock with each other. Through the elastic mounting of the tongue 31 and its own elasticity, the interlocking can again be released by a strong pull.

The described construction example for the track segment parts 2 has another special advantage in that the track segment parts 2 and the connecting pieces 3 can be separated from each other and again can be interlocked, that is, in that also by the use of the track segment parts, the track segments of different lengths can be built and in that also with the use of merely two connecting pieces 3, the track segments 1 can be used with any number of track segment parts 2. A complete track can even be built consisting only from track segment parts 2. It is merely a corresponding number of track segment parts 2 necessary.

Thereby, preferably, the hook-forming ends 21 (which point to each other) of jaws 20 of one pair display funnel-like tapers 37 which run one after another in the direction of the oval space 22. In a similar manner, inside of the oval space 22, the sloping surfaces 38 are formed which run to the hook-forming ends 21. During the assembly the pin 24 presses over the tapers both jaws 20 so far apart that the pin 24 can enter into the oval space. During dismantling the pin 24 presses by the construction against the sloping surfaces 38, both jaws 20 apart until the pin 24 leaves the oval space 22. In any case, after the determination of the dimensioning of the tapers (sloping diagonals) 37 and sloping surfaces 38, more or less a great strength is necessary for the assembly or dismantling. It is advantageous when the strength for the assembly is lower than for the dismantling, as in the case by the design of the tapers 37 and of the sloping surfaces 38 by the construction example (compare especially FIG. 6).

Especially the dimensioning can be such that stronger children and adults can achieve the assembly or dismantling merely through exercising a pressure or a pull by hand. On the other hand, also smaller children must be able to connect the track segment parts 2 together or separate them from each other. For this purpose, preferably a tool is furnished. This has the educational advantage, in that the children already learn early that with the help of tools results can be obtained, which cannot be obtained by means of the manual action alone.

Such suitable tools are explained more thoroughly as follows.

Figure 14:
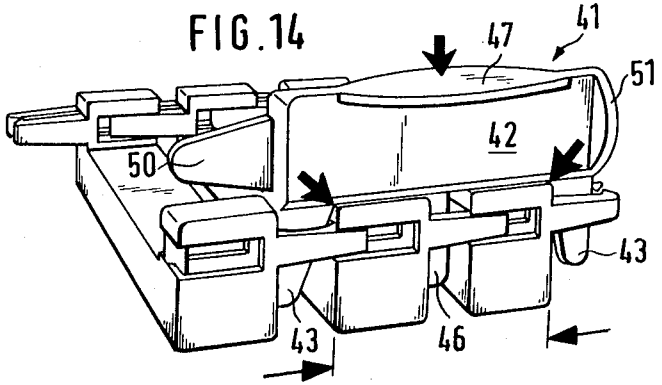
FIGS. 13 and 14 are perspective views of the tool of FIG. 12 connecting adjacent track segment parts.
Figure 12:
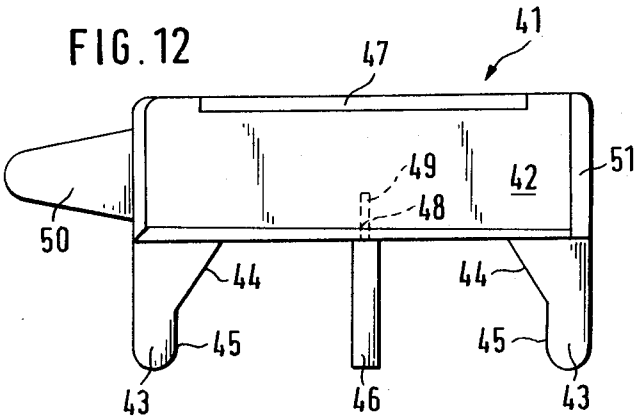
FIG. 12 is an elevation view of a tool used to join together and loosen track segment parts.
Figure 13:
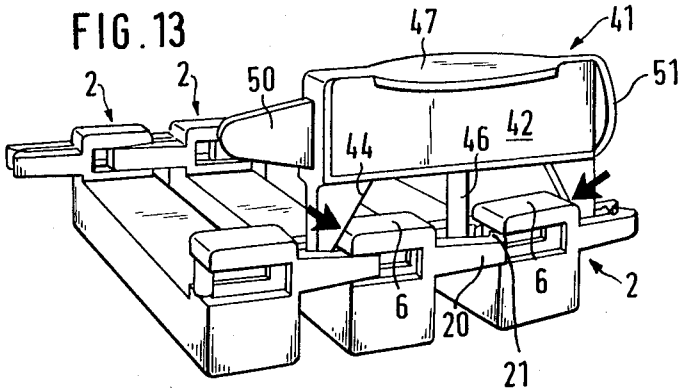
Figure 15:
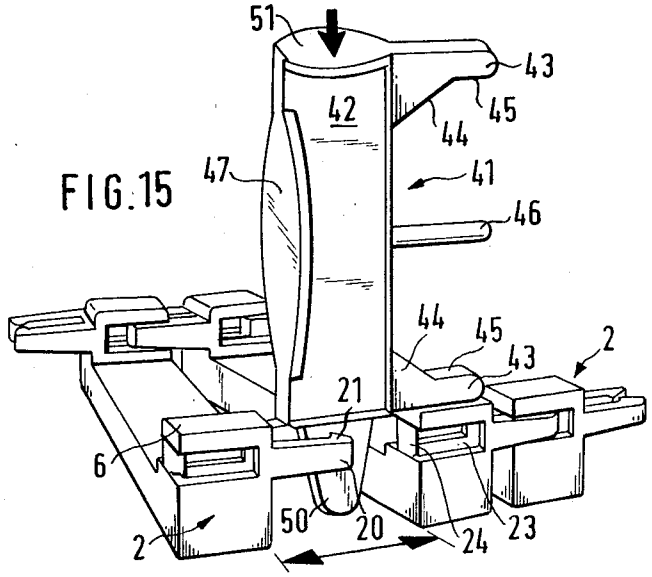
FIG. 15 is a perspective view of the tool separating adjacent track segment parts.

FIG. 12 shows a universal tool 41 which is suitable for the assembling and for dismantling. In FIGS. 13 to 15 its method of operation is explained.

The tool 41 displays an essentially rectangle-forming foundation 42 from the longitudinal edge of which two strap attachments 43 project away, these strap attachments being formed symmetrically to each other. Close to the rounded outer ends run edges which are lying opposite to each other, almost parallel, and turn into tapers 44 which pass to each other. The parallel edges 45 have such a distance from each other that two track segment parts 2, which are separated from each other, have a place in-between. The smallest distance of both tapers 44 is such that by construction of the upper edges of the reciprocal guide edges 6 the hook-forming ends 21 of the linkage element 8 of a track segment part 2 have securely encircled the pin 24 of the receiving part 10 of the other track segment element 2 (compare FIGS. 13 and 14). Preferably, in the area of the opposite lying edges of both strap attachments 43, in the middle, a guide pin 46 is provided, the measurements of which are such that they can enter through the oval space 22 between two jaws 20 of one pair. This guide pin 46 simplifies a vertical guidance of the universal tool 41 when for the assembly it is being pressed onto a pressure plate on the other edge. As it is shown in FIG. 12, the guide pin 46 can also be removable and, in addition, displays an extension 48, which can be inserted into a corresponding cavity 49 in the foundation 42. A flat surface 47, transverse to the foundation 42, facilitates pressing of the tool downward to the position shown in FIG. 14.

On one of the shorter edges of the foundation 42 a wedge extension 50 projects, while on the opposite edge another pressure plate 51 is furnished. For dismantling, the wedge extension 50 is introduced into the oval space 22 between two jaws 20 of one pair. By applying pressure on the pressure plate 51 the tapered edges of the wedge extension 50 are applied to the jaws lying opposite to each other upper edges of the guide edges 6 of the adjacent track segment parts 2 and press these apart in such a manner that the engagement between the hook-forming ends 21 and the pin 24 is separated (compare FIG. 15), that is, the width of the wedge extension 50 close to the edge of the foundation 26 is somewhat greater than the stroke h (compare FIG. 6).

Moreover, the method of operation of this universal tool 41 is illustrated more clearly in FIGS. 13, 14 and 15.

In FIGS. 16 and 17 a special dismantling tool 52, as well as its method of operation, is illustrated, which essentially is similar to that of the wedge extension 50. The dismantling tool 52 displays a wedge extension 53, which corresponds to the wedge extension 50 of the universal tool 41, and displays a pressure handle 54 on which the pressure is exercised. It is shown that the method of operation of the dismantling tool 52, in accordance with FIG. 17, corresponds to that of the universal tool 41, which is in accordance with FIG. 15.

In a corresponding way, the FIG. 18 shows an assembling tool at 55 with two strap extensions 56 (which project away from one side) corresponding to the strap extensions 43 of the universal tool 41 and corresponding tapers 57. Also here a guide pin 58 is mountable over an extension 59 and a cavity 60. Further, a pressure handle 61 is furnished.

The method of operation of the dismantling tool 55 corresponds to the method of operation which is explained for the universal tool 41 by means of FIGS. 13 and 14. It is still to be noted hereby that by the strap extensions 43 or 56 the parallel edges 45 or 62 are not essentially required, however, they achieve a better guidance. The strap extensions 43 or 56 can merely display the tapers 44 or 57, as it is clarified in FIG. 14.

In FIGS. 19 to 22 a further dismantling tool 63 is illustrated, which acts not by pressure but by turning. For this purpose, the dismantling tool 63 displays an almost 4-edged extension 64, which projects downward, and which tapers itself nearly cone-shaped at least relative to the two surfaces, which lie opposite each other. Further, on the 4-edged extension 64, a turning handle 65 is provided. For dismantling or loosening of two adjacent track segment parts 2 the 4-edged extension 64 is introduced so far into the oval space 22, that the surfaces of the 4-edged extension 64 become adjacent to the edges of the oval space 22. By means of turning the turning handle 65 the jaws 20 are so far spread from each other over the edges of the 4-edged extension 64, that the hook-forming ends 21 can come beyond the catch with the pin 24 of the adjacent track segment part 2 (compare FIG. 22). With this dismantling tool 63 the assembly process can essentially be simplified by spreading apart the jaws 20 and a subsequent compression of the adjacent track segment parts 2 by the simultaneous removal of the dismantling tool 63 (compare also FIG. 21).

The construction example of a flexible track segment, which has been explained up until now, adapts itself for play vehicles (cars) which are driven and handled on the travelling surface 4 or 5 or on the guide edge 6 or 7. In case if the flexible track segment should be used in accordance with the invention for the play vehicles, which are driven on the upper side of the guide edge 6 or 7, a construction example is advantageous which is explained more thoroughly in the following. For the explanation, so that the same basic principle is used, however, the same designations (reference symbols) are used and in the following merely the changes or the additional steps (measures) are explained more thoroughly.

Figures 23, 24, 25, 26:
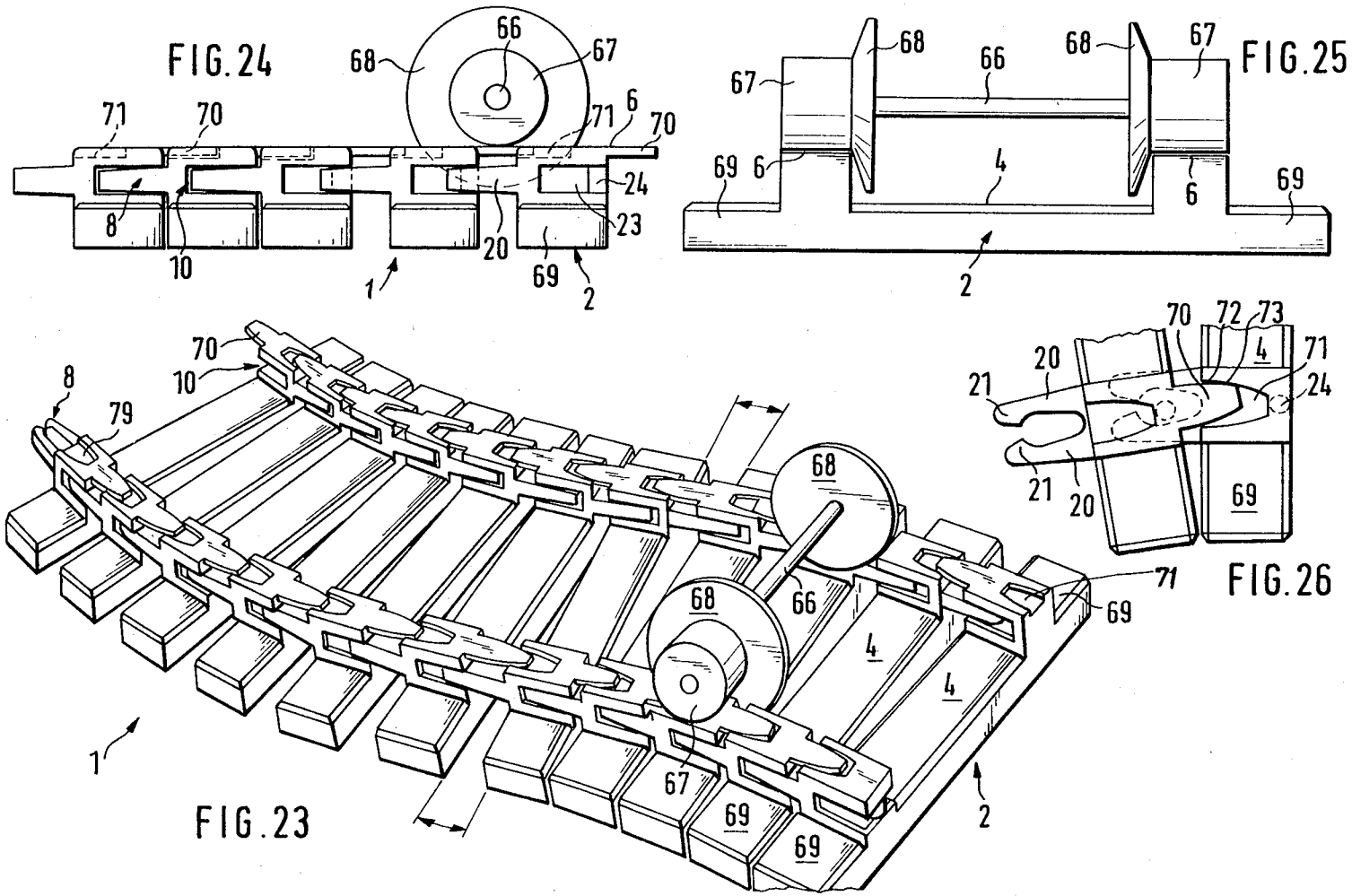
FIG. 23 is a perspective view of a track segment having an alternative form of track segment parts guiding a wheel axle with wheels.
FIG. 24 is a side elevation view of the wheel axle on the track segment of FIG. 23.
FIG. 25 is an end elevation view of the wheel axle on the track segment of FIG. 23.
FIG. 26 is a fragmentary plan view of the connection between adjacent track segment parts of FIG. 23.

As it follows from FIGS. 23 to 25, the toy track displays a wheel axle 66 with wheels 67, which have, lying within, a wheel flange 68. A toy vehicle, which is equipped with one such wheel set (not illustrated) runs on the guide edges 6 of the track segment parts 2 as a railroad on rails.

In order to optically obtain the impression of a toy railway, the track segment part 2 displays, on both sides of the guide edges 6, extensions 69 of the travelling surface 4, so that the impression of the railroad ties is formed.

A further essential difference opposite to the construction example, which has been explained up until now, is in the upper surface shaping of the guide edge 6. On one side of the guide edge 6, preferably that one on which the receiving part 10 is built, a tongue 70, which is snug (compact) with the upper side of the guide edge 6, projects away horizontally. Proceeding from the other side of the guide edge 6 (here also that from which the linkage element 8 projects away), a cavity 71 is formed, into which the tongue 70 of the adjacent track segment part 2 reaches. Furthermore, the linkage element 8 and the receiving part 10, have essentially the already explained assembly. The side edges of the tongue 70 and cavity 71 are, on one side, symmetrical to each other, and, on the other side, they are formed curved in such a manner that, as illustrated in FIG. 26, a bending (twisting) in the horizontal plane is possible in such a manner that the tongue 70, over the side edge 72, can slide on the side edge 73 of the cavity 71, whereby a free mobility remains guaranteed in the horizontal plane.

Figure 28:
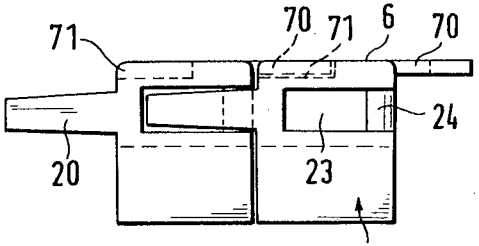
FIG. 28 is a side elevation view of the connection between adjacent track segment parts of FIG. 23.

In this way, it is achieved that the upper side of the guide edge 6, at least on relation to the guidance of wheels 67 has a pattern, as it especially follows from FIGS. 24 and 28.

Figure 27:
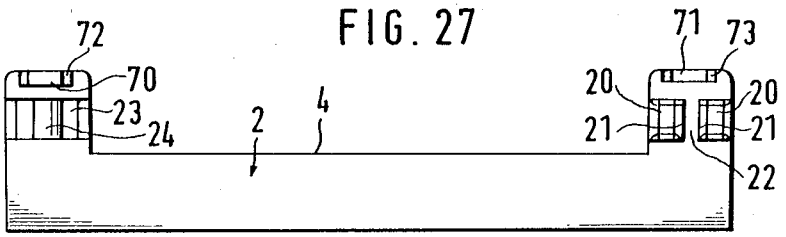
FIG. 27 is an end view of one of the track segment parts of FIG. 23.

FIG. 27 shows that the track segment part 2 can also be provided without the extension 69, or that the cavity 71 and tongue 70 can also be provided by the track segment parts 2, by which the toy vehicle runs on the travelling surface 4. Then a special optical impression is obtained.

Figure 30:
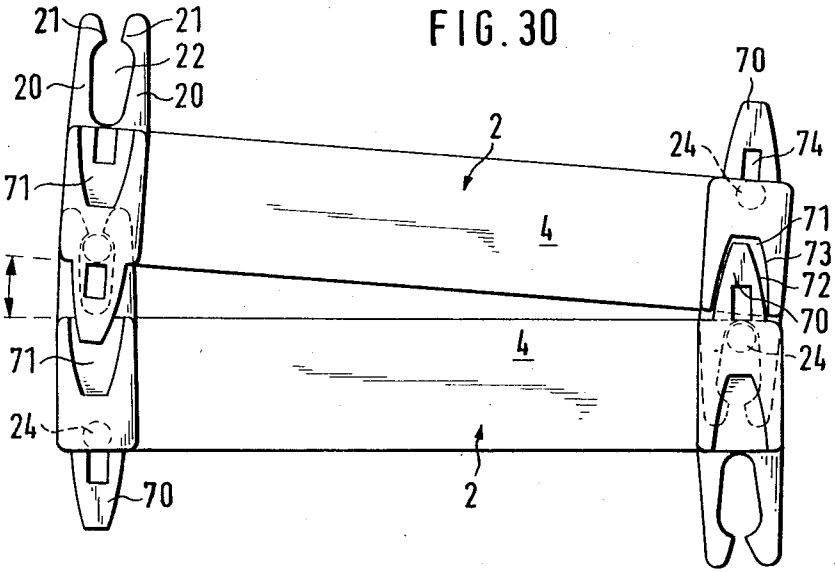
FIG. 30 is a plan view demonstrating relative horizontal shifting between adjacent track segment parts.
Figure 29:
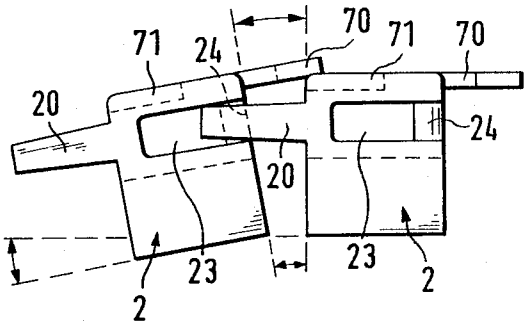
FIG. 29 demonstrates relative vertical shifting between adjacent, joined track segment parts at the connection of FIG. 28.

FIG. 29 shows in a special manner the flexibility in the vertical plane, which is obtained through the tapering of jaws 20 in such a manner that the pin 14 can be tilted in the vertical plane in the oval space 22. In case a tongue 70 is provided, then it juts out somewhat over the adjacent track segment part 2, which, however, is not disturbing. FIG. 30 shows once more the reciprocal flexibility in the horizontal plane of the adjacent track segment parts 2, when tongues 70 and cavities 71 are provided. Then it is also illustrated that the side edges 72 and 73 can mutually roll off somewhat comparable with a gear-tooth system. Further it is illustrated that openings 74 can be provided in the tongues. In this way, on one hand, material is saved, whereby the uniform pattern of the upper side of the guide edge 6 remains retained and, on the other hand, a certain elasticity of the tongue 70 against the guide edge 6 is obtained, which by the movement in the vertical plane (FIG. 29) achieves a certain resilience of the tongues 70.

A track segment 1 has proved to be advantageous by which the dimensioning of the track segment parts 2 and of the receiving pieces 3 is such that in the assembled condition (state) it corresponds to a rigid 1/1 track segment and in a dismantled condition it corresponds to 3/2 track segment. The swivel-feature in the horizontal plane, that is one guide edge completely assembled, the other guide edge completely disassembled, should obtain about one $\frac{1}{4}$-curvature. With measurements in this order of magnitude, in most cases, a track, which is constructed with rigid track segments, can be finished without problems. As explained, also additional track segment parts or complete track pieces 1 can be used in the same construction. Finally, for the reduction of the bending radius between two adjacent track segment parts 2, by merely one guide edge (and by the construction form which is in accordance with FIGS. 5 to 7 placed on the head) can be inserted, whereby the bending radius of the track is decreased to a considerable extent.

Of course, still numerous other construction forms are possible.

I claim:

1. A flexible track segment for carrying freely moving, driven, track-bound toy vehicles comprising:

a plurality of track segment parts each having a travelling surface and first and second oppositely facing sides spaced in the direction of travel of the toy vehicles along the track segment; and means connecting adjacent track segment parts for universal adjustment relative to each other, including relative vertical and longitudinal shifting between adjacent track segment parts along the direction of travel of the toy vehicle to effect horizontal and vertical curves comprising a locking part projecting from the first side, a receiving part on the first side spaced from the locking part and mating locking and receiving parts on the second side of an adjacent track segment part, said locking parts comprising a pair of jaws with hook-forming ends which are directed to each other, said receiving parts comprising an opening in which a pin is arranged vertically to the side of which said receiving part is associated, the outer dimensions of which are smaller than the jaws and larger than the hook-forming ends, whereby the travelling surfaces on the track segment parts can be arranged relative to each other to derive a desired course for the toy vehicle.

2. The flexible track segment of claim 1 wherein a surface section of the pin aligns substantially with the side with which it is associated said pair of jaws having at most about one corresponding length of the travelling surface of the track segment part.

3. The flexible track segment of claims 1 or 2 wherein at least one of the sides of the jaws and hooks is tapered.

4. The flexible track segment of claims 1 or 2 wherein connecting pieces for connection with other fixed track segments for relative shifting in only a longitudinal direction are provided, on one side of which a contact link is provided, and on the other side linkages are provided for the connection to the other adjacent track segments.

5. The flexible track segment of claims 1 or 2 wherein the jaws are substantially rigid and resistant to bending, however, at least by means of a tool, can be parted from each other in such a manner that the joined-together track segments parts or the track segment part and the connecting piece can be separated from each other.

6. The flexible track segment of claims 1 or 2 wherein the jaws are substantially rigid and resistant to bending in combination with a tool, said tool having means for separating the segment parts and connecting pieces from each other by turning.

7. The flexible track segment of claims 1 or 2 wherein the jaws are substantially rigid and resistant to bending in combination with a tool, said tool having tapered means for forcing the jaws part by pressing.

8. The flexible track segment of claims 1 or 2 wherein the jaws are substantially rigid and resistant to bending in combination with a tool, said tool having means for forcing the jaws apart by pressing, and a guiding link is provided essentially for the perpendicular guidance of the tool on the travelling track surface by means of pressure.

9. The flexible track segment of claims 1 or 2 further including rigid but detachable, at least in the area of the edge, mountable supports which display a ball which snaps into a corresponding cup-forming cavity at the bottom side of the track segment part.

10. A flexible track segment for carrying freely moving, driven, track-bound toy vehicles comprising:

a plurality of track segment parts each having a travelling surface and first and second oppositely facing sides spaced in the direction of travel of the toy vehicles along the track segment; and means connecting adjacent track segment parts for universal adjustment relative to each other, including relative shifting between adjacent track segment parts along the direction of the toy vehicle to effect horizontal and vertical curves, said means comprising a locking part projecting from the first side, a receiving part on the first side spaced from the locking part and mating locking and receiving parts on the second side of an adjacent track segment part, said track segment having spaced guide edges and the locking and receiving parts located at the guide edges, said locking parts projecting on a track segment part on each of the guide edges and in opposite directions, whereby the travelling surfaces on the track segment parts can be arranged relative to each other to derive a desired course for the toy vehicle.

11. A flexible track segment for carrying freely moving, driven, track-bound toy vehicles comprising:

a plurality of track segments parts each having a travelling surface and first and second oppositely facing sides spaced in the direction of travel of the toy vehicles along the track segment; and means connecting adjacent track segment parts for universal adjustment relative to each other, including relative shifting between adjacent track segment parts along the direction of travel of the toy vehicle to effect horizontal and vertical curves, said means comprising a locking part projecting from the first side, a receiving part on the first side spaced from the locking part and mating locking and receiving parts on the second side of an adjacent track segment part, said track segment having spaced guide edges and the locking and receiving parts located at the guide edges;

an upper side of the guide edges adjacent the first sides of the track segment parts are provided with tongues projecting in the direction of the travelling surface and, on the second side, corresponding cavities are provided in such a manner that the tongues of the track segment part with play reach in the corresponding cavity of the adjacent track segment part, said tongues and cavities cooperating to maintain alignment of adjacent track segment parts upon relative shifting occurring therebetween, whereby the travelling surfaces on the track segment parts can be arranged relative to each other to derive a desired course for the toy vehicle.

12. A flexible track segment for carrying freely moving, driven, track-bound toy vehicles comprising:

a plurality of track segment parts each having a travelling surface and first and second oppositely facing sides spaced in the direction of travel of the toy vehicles along the track segment; and means connecting adjacent track segment parts for universal adjustment relative to each other, including relative vertical and longitudinal shifting between adjacent track segment parts along the direction of travel of the toy vehicle to effect horizontal and vertical curves, said means comprising cooperating locking and receiving parts associated with the first and second sides of adjacent track segment parts to establish connection therebetween, said locking parts each comprising a pair of jaws with hook-forming ends which are directed to each other, said receiving parts comprising an opening in which a pin is arranged vertically to the first side, the outer dimensions of which are smaller than the jaws and larger than the hook-forming ends, connection between locking and receiving parts on adjacent track segment parts is established at least at a first and second location spaced transversely to the direction of travel of the toy vehicle, whereby the travelling surfaces on the track segment parts can be arranged relative to each other to derive a desired course for the toy vehicle.

13. The flexible track segment of claim 12 wherein the track segment has spaced guide edges and the locking and receiving parts are located at the guide edges.

14. The flexible track segment of claim 12 wherein said locking parts and receiving parts are engageable with each other only upon directing the track segment parts towards each other in the direction of movement of the toy vehicle along the track segment.

15. The flexible track segment of claim 14 wherein guide means are provided at the guide edges to maintain the alignment of the track segment parts upon the track segment parts moving relative to each other.

16. The flexible track segment of claims 1 or 2 further including rigid, but detachable mountable supports which displays a ball which snaps into a corresponding cup-forming cavity at the bottom side of a connecting piece.

* * * * *